United States Patent [19]

Londerville

[11] 4,421,473

[45] Dec. 20, 1983

[54] APPARATUS FOR OPERATING A BURNER AT AN OPTIMAL LEVEL

[75] Inventor: Steve B. Londerville, Half Moon Bay, Calif.

[73] Assignee: Coen Company, Inc., Burlingame, Calif.

[21] Appl. No.: 287,383

[22] Filed: Jul. 27, 1981

[51] Int. Cl.[3] ..... F23N 5/00

[52] U.S. Cl. ..... 431/76; 431/89; 236/15 BD; 236/15 E; 137/100; 137/487

[58] Field of Search ..... 431/12, 75, 76, 89, 431/90; 236/15 BD, 15 E; 110/186; 137/455, 486, 100, 487

[56] References Cited

U.S. PATENT DOCUMENTS

| | | | |
|---|---|---|---|
| 4,113,418 | 9/1978 | Larcen | 431/12 |
| 4,249,886 | 2/1981 | Bush | 431/12 X |
| 4,264,297 | 4/1981 | Van Berkum | 431/76 |

FOREIGN PATENT DOCUMENTS

| | | | |
|---|---|---|---|
| 2930707 | 2/1981 | Fed. Rep. of Germany | 236/15 BD |

*Primary Examiner*—Samuel Scott

*Assistant Examiner*—Margaret A. Focarino

*Attorney, Agent, or Firm*—Townsend & Townsend

[57] ABSTRACT

A system for marginally adjusting the fuel flow to a burner to maintain the proper oxygen content in the exhaust from the burner is disclosed. The burner is of the type where both the fuel and air flow rates are adjusted in a substantially fixed ratio in response to load changes on the system with the fuel being adjusted by a fuel control valve mounted in a fuel supply line. A self-operating pressure regulating valve having an actuator responsive to the differential pressure across the fuel control valve is mounted in the fuel line upstream of the fuel control valve. A set point adjustment mechanism is mounted on the regulating valve actuator to adjust the set point of the regulating valve in response to an oxygen controller which senses the oxygen content in the stack gases. The set point adjustment mechanism has a cam assembly which continously adjusts the set point of the regulator actuator by varying the compression on a spring loaded diaphragm therein. A positioner is interposed between the oxygen controller and the set point adjustment mechanism to provide the necessary mechanical input to the set point adjustment mechanism.

6 Claims, 4 Drawing Figures

APPARATUS FOR OPERATING A BURNER AT AN OPTIMAL LEVEL

BACKGROUND OF THE INVENTION

1. Field of the Invention

The present invention relates generally to control valves, and more particularly, it relates to a mechanism specially adapted to adjust the set point of a pressure differential control valve found in the fuel line to furnaces, boilers and the like.

2. Description of the Prior Art

It is known that the ratio of air to fuel in the mixture fed to burners for furnaces, boilers and the like must be carefully controlled for efficient burning. Too much air wastes energy by heating the unused air. Too little air leads to incomplete combustion of the fuel, which in addition to wasting energy, forms pollutants and potentially leads to explosive conditions when the unburned fuel is again exposed to air.

Typically, the total amount of fuel and air fed to a burner is primarily controlled on load. That is, a load controller increases (or decreases) the flow of both fuel and air to the burners when it senses that the load has, or is about to, increase (or decrease). The fuel flow is varied by a fuel control valve (FCV) in the fuel line and the air flow is adjusted by an air damper in the windbox. In the simplest form of such control, the air and the fuel are continuously adjusted in a fixed ratio which is chosen as optimum at start-up in view of the fuel characteristics and ambient conditions prevailing at that time. As the fuel characteristics and the ambient conditions change, however, the optimum air to fuel ratio changes and the simple load control scheme is unable to respond.

To maintain an optimum air to fuel balance over time, it is common to marginally adjust the air flow or the fuel flow, or both, in response to one or more measured characteristics of the stack gases, typically oxygen content. One approach marginally adjusts the air flow by trimming the position of the air damper which is under the primary control of the load controller. Typically this is accomplished by placing an adjustable mechanical linkage between the damper actuator and the damper which imposes a trim adjustment on the damper in response to an oxygen controller, or the like, adapted to maintain the optimum combustion characteristics in the burners. While this approach generally works, it suffers from certain disadvantages. Failure of the mechanical linkage can, in the worst case, stop the flow of air entirely which leads to a highly explosive condition. Moreover, the percentage adjustment (trim) imposed at a given load condition will not necessarily correspond to the percentage change required when the damper position has been changed by the load controller. Such nonlinear response of the trim controller in respect to the primary controller can lead to instability in the trim control system, particularly during periods when the load fluctuates rapidly.

To compensate for variations in pressure in the incoming fuel, it is known to place a differential pressure control valve (DPCV) in the fuel line ahead of the FCV. The DPCV used is typically a self-operated pressure control valve having a diaphragm actuator actuated by the fuel line pressure. By connecting one diaphragm tap downstream of the FCV and the other diaphragm tap upstream of the FCV, the DPCV responds to variations in the pressure differential across the FCV to maintain that differential pressure at a constant set point. An increase in the differential pressure across the FCV acts to close the DPCV, slowing the flow of fuel and reducing the differential pressure across the FCV. Conversely, a decrease in the differential pressure across the FCV acts to open the DPCV and to increase the differential pressure across the FCV.

Heretofore, it has been known to provide such DPCV with means for manually adjusting the set point only. The DPCV would be adjusted manually by the user at start-up of the system and thereafter would act to control the differential pressure across the FCV at the preselected fixed value.

SUMMARY OF THE INVENTION

The present invention provides a method and apparatus for adjusting the set point of a differential pressure control valve (DPCV) found ahead of a fuel control valve (FCV) in a fuel supply line for industrial burners and the like. The apparatus includes a set point adjustment mechanism which causes the DPCV to vary the differential pressure across the FCV in a manner which maintains the air-to-fuel ratio at a desired value regardless of the operating load of the burners. The adjustment mechanism is typically driven by a fuel trim controller which measures a combustion characteristic, such as oxygen content in the stack gases, and activates a positioner which is mechanically linked to the set point adjustment mechanism.

The set point adjustment mechanism is adapted to be mounted at the top of the DPCV which is a self-operated pressure control valve having a spring-loaded diaphragm actuator where the set point is adjusted by varying the tension on the spring. The adjustment mechanism includes a mechanical link which directly engages the set point spring on the DPCV actuator, a rotatable shaft, and an eccentric cam which is mounted on the shaft. The cam drives the mechanical link which in turn varies the set point of the DPCV.

The particular design of the set point adjustment mechanism has a number of advantages over the prior art. First, the rugged construction and limited number of moving parts makes it virtually fail proof. Second, should either the oxygen controller or the positioner fail, the adjustment mechanism cannot be driven to either fully open or fully close the DPCV. This safety feature is inherent in the cam which can drive the rod only a limited amount regardless of the degree of attempted rotation by the positioner. Finally, by controlling the pressure drop across the FCV, an equal percentage correction is obtained regardless of the load condition of the burners. This assures that the proper air to fuel ratio will be maintained over the entire range of operating conditions.

DESCRIPTION OF THE PREFERRED EMBODIMENT

Figure 1:
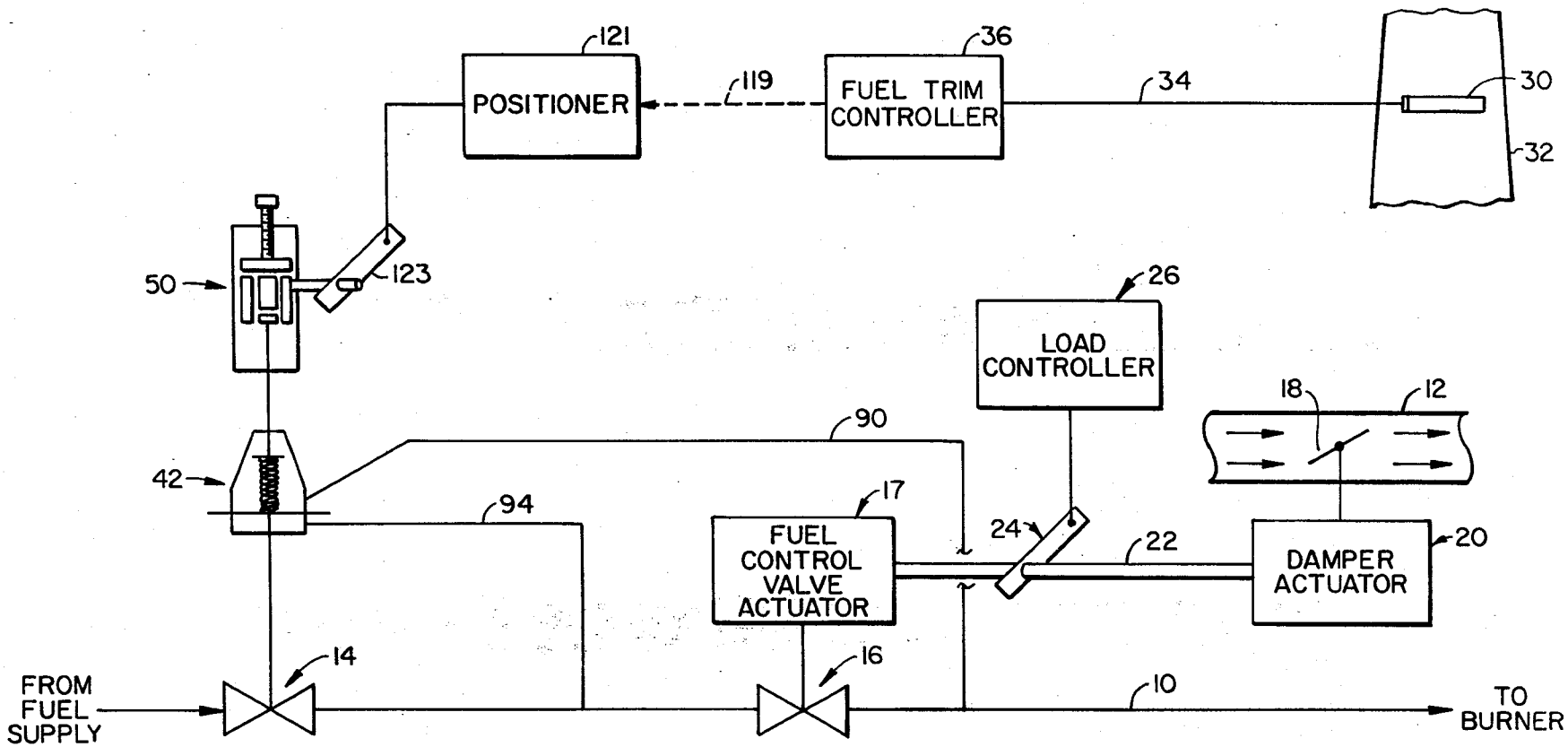
FIG. 1 is a schematic representation of a fuel control system employing the set point adjustment mechanism of the present invention.

Referring to FIG. 1, the air-to-fuel ratio control system of the present invention is illustrated. The system includes a fuel supply line 10 and a windbox 12, together with associated valves, actuators and control devices. The fuel supply line 10 is connected at its left end (as viewed in FIG. 1) to a source (not shown) of fuel at a relatively constant pressure. The fuel flows to the right, first passing through a differential pressure control valve (DPCV) 14 and a fuel control valve (FCV) 16 prior to reaching one or more burners (not shown) in a boiler, furnace, or the like. The windbox 12 receives air from a fan (not shown) and directs the air to an air register (not shown) associated with the burners fed by fuel line 10. The windbox 12 includes a damper 18 therein for adjusting the flow of air to the burner, as described hereinafter.

Both the fuel and air flow to the burners will be controlled primarily in response to load changes on the system. When the load increases, it is necessary to increase the flow of both fuel and air to meet the increased energy requirement. Conversely, when the load decreases it is necessary to decrease the flow of both fuel and air so that the energy is not wasted. A typical system for achieving such control is illustrated in FIG. 1 and comprises mechanically linking both a damper actuator 20 and a fuel control valve actuator 17 with a single shaft 22 commonly referred to as a jack shaft. A single lever 24 mounted on shaft 22 is operatively connected to a load controller 26, and the load controller is thus able to simultaneously control both the fuel flow and the air flow by rotating the shaft 22 a calculated amount in response to sensed changes in load.

By choosing the proper fuel-to-air ratio initially and properly adjusting the various components of the control system, the burner operates efficiently over the entire range of expected load so long as external conditions remain constant. However, variation in ambient conditions, variation in the fuel supply pressure and other such changes, cause the air-to-fuel ratio to deviate from optimum. It is thus necessary to provide additional means for controlling the air-to-fuel ratio in response to these changes. Variations from the proper air-to-fuel ratio may be detected by measuring the oxygen content, carbon monoxide content, opacity or similar characteristics of the stack gases, all of which are indicative of the amount of excess oxygen reaching the burner. A sensor 30, which may measure any of such characteristics, is mounted in an exhaust stack 32. The sensor 30 is connected to a fuel trim controller 36 by an output line 34.

DPCV 14 is a conventional self-operating valve having a diaphragm actuator 42 (best illustrated in FIG. 2) operatively connected to the process line being controlled. In this particular application, the valve actuator 42 is connected on either side of FCV 16 so that an increase in differential pressure across FCV 16 operates to close DPCV 14, while a decrease in the pressure drop operates to open DPCV 14. In this way, DPCV 14 acts to maintain a constant differential pressure across FCV 16. While DPCV 14 alone compensates for some of the changes arising from changed ambient conditions, it is not enough by itself. The present invention further adjusts the fuel flow to the burners in response to measured changes in the stack gases to further compensate for changes in the ambient conditions. More particularly, a set point adjustment mechanism 50 is mechanically linked to the DPCV actuator 42 to adjust the set point thereof in response to the fuel trim controller 36.

Figure 2:
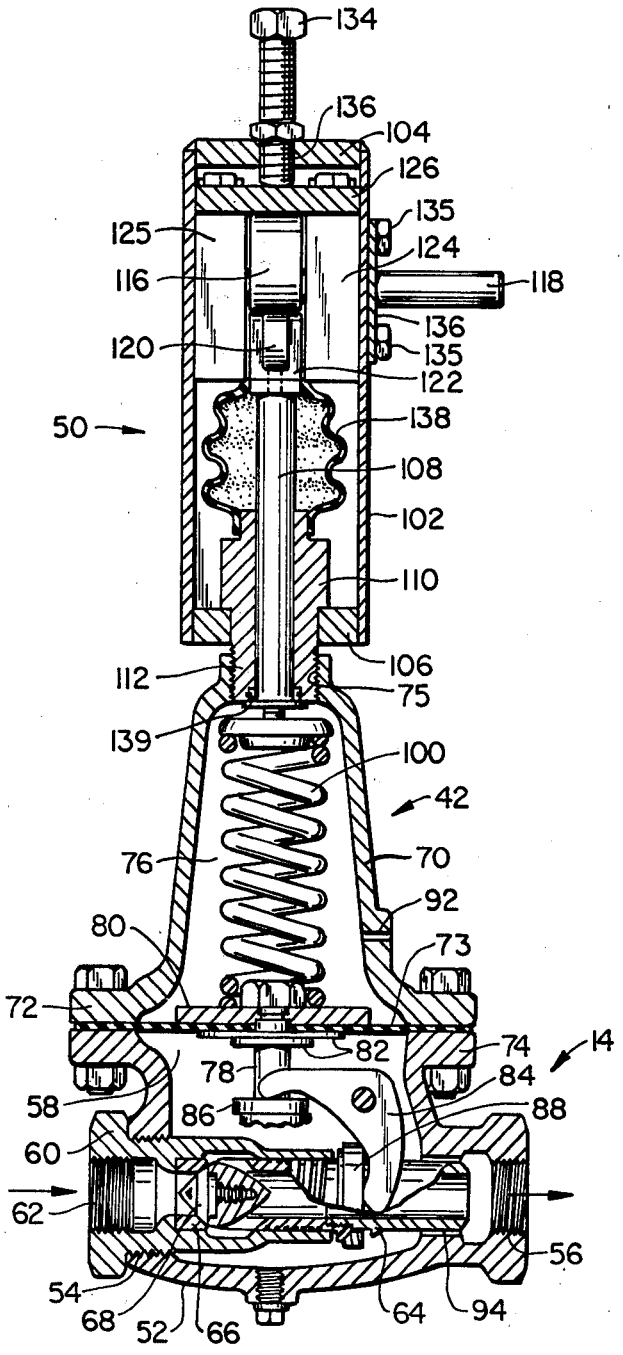
FIG. 2 is an elevational view of the set point adjustment mechanism of the present invention mounted on a self-operated pressure control valve, shown in section.

Referring now to FIG. 2, the construction of DPCV 14, the DPCV actuator 42 and the set point adjustment mechanism 50 will be described in detail. The particular control valve and actuator illustrated are a Cashco type 1000 HP pressure reducing and regulating valve manufactured by the A. W. Cash company of Decatur Illinois and described in their bulletin 65-1000 which is incorporated herein by reference. The set point adjustment mechanism 50 of the present invention will operate with any of a wide variety of commercially available control valves, or with a specially constructed valve, and the Cashco valve is used as an example only.

Briefly describing the construction of the control valve and actuator combination (DPCV 14 and DPCV actuator 42), a valve body 52 having a threaded inlet opening 54 and a threaded outlet connection 56 defines a lower diaphragm chamber 58 in its interior. A stationary flow tube 60 is threaded into the inlet opening 54 and extends approximately halfway across the lower diaphragm chamber 58 in a direction toward the outlet connection 56. A moving piston jet 64 is received in the interior end of the flow tube 60 and is free to reciprocate therein. Together, the flow tube 60 and piston jet 64 define a passageway from an inlet connection 62 to the outlet connection 56. A valve seat 66, mounted inside the flow tube 60 and secured thereto, engages a valve plug 68 secured at the interior end of the piston jet 64. Thus, reciprocation of the piston jet 64 within the flow tube 60 acts to open and close the flow path through the valve in response to the valve actuator 42, as described hereinbelow.

The valve actuator 42 comprises a bell-shaped housing 70 having a flanged lip 72 formed about its lower periphery and a threaded opening 75 at its upper end. A diaphragm 73 is secured between the flange 72 of the bellshaped housing 70 and a similar flange 74 formed at the upper end of the valve body 52. The housing 70 thus defines an upper diaphragm chamber 76 above the diaphragm 73.

A stem 78 is secured to the diaphragm 73 by a press plate 80 and a pair of washers 82 and extends downward into the lower diaphragm chamber as illustrated in FIG. 2. A rocker arm 84 is pivotally mounted within the chamber 58 and engages an end cap 86 at the lower end of the stem 78. The opposite end of the rocker arm 84 engages a circumferential shoulder 88 extending about the moving piston jet 64 so that movement of the rocker arm causes the piston jet to reciprocate within the stationary flow tube 60. Thus, it can be seen that movement of the diaphragm 73 upward or downward will cause the piston jet 64 to reciprocate within the stationary flow tube 60 which in turn causes opening and closing of the DPCV 14.

Such movement in the diaphragm 73 is induced by fluid pressure in the fuel line 10. As illustrated in FIG. 1, the upper chamber 76 is connected by a capillary tube 90 to a port 92 (FIG. 2) formed in the side of the bell-shaped housing 70. The tube 90 is connected to fuel line 10 at a point downstream from FCV 16. The lower diaphragm chamber 58 is directly connected to the fuel line 10 by a passage 94 formed between the valve body 52 and the stationery flow tube 60. Thus, the diaphragm 73 is actuated by the differential pressure across FCV 16 with an increased differential pressure acting to close the valve (i.e., move the diaphragm upward) and a decreased differential pressure acting to open the valve.

The set point of DPCV 14 is that value of the differential pressure across FCV 16 at which the forces acting on diaphragm 73 of actuator 42 are in equilibrium. The set point may be adjusted by biasing the diaphragm 73 with a spring 100 mounted within the housing 70 and engaged at its lower end against the press plate 82. By varying the compression of the spring 100, the neutral (or shelf) position of the diaphragm 73 can be adjusted, which determines the set point of the control valve. By increasing the compression of spring 100 the diaphragm 73 is urged downward and DPCV 14 is biased opened, thus allowing a larger differential pressure across FCV 16 at equilibrium (i.e., set point). By decreasing the compression, the opposite result is achieved.

In conventional pressure regulators and in prior systems for controlling the fuel flow to burners, a manual means is provided for adjusting the set point of the pressure regulator, i.e., adjusting the compression and the spring 100. The manual means is typically an adjusting screw mounted in the threaded connector 75 of the housing 70 whereby rotation of the screw adjusts the spring compression. The present invention provides the set point adjustment mechanism 50 for continuously adjusting the set point of DPCV 14 in response to changes in the composition of the exhaust gases over time.

Figure 3:
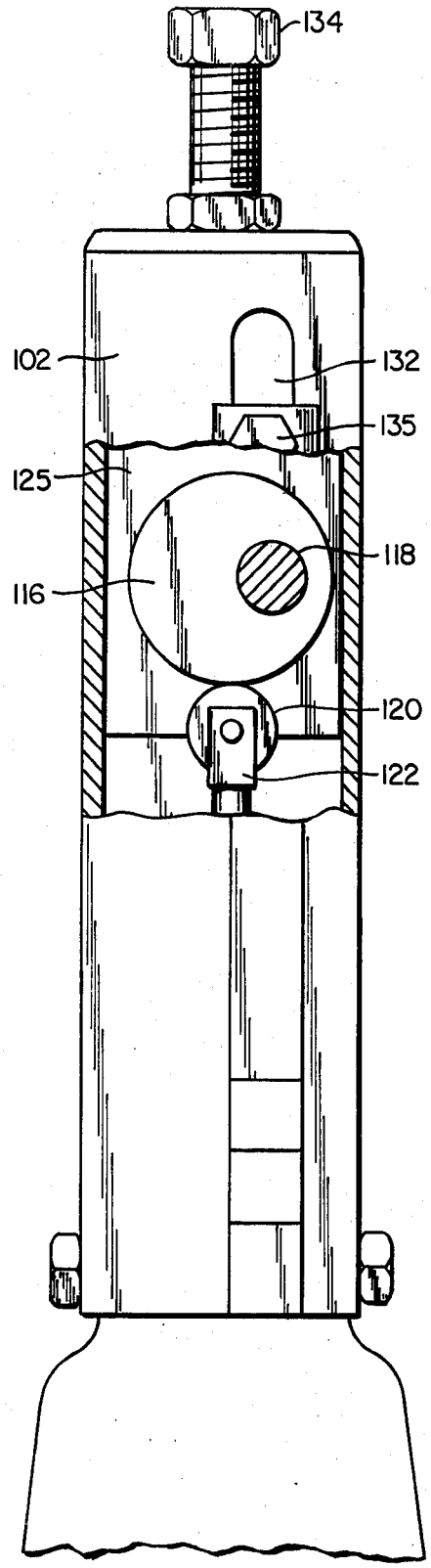
FIG. 3 is a side view of the set point adjustment mechanism of the present invention with portions broken away.

Referring to FIGS. 2 and 3, the set point adjustment mechanism 50 comprises an elongate housing 102 having a square cross-section, closed at its upper end by a top plate 104 and at its lower end by a bottom plate 106. A rod 108 is axially received in a retainer 110 which is secured in the bottom plate 106 of the adjustment mechanism 50. The retainer 110 has a threaded end 112 which projects below the bottom plate 106 and is received in the threaded opening 75 of the housing 70. The rod 108 rests at its lower end to the compression spring 100 and reciprocation of the rod effects changes in the set point of DPCV 14, as described hereinabove. Rod 108 is caused to reciprocate by a cam 116 eccentrically mounted on a shaft 118 an end of which protrudes transversely from housing 102. As the shaft is rotated, the cam 116 engages a cam follower 120 rotatably mounted on the upper end of the rod 108 in a clevis 122. Thus, the set point of DPCV 14 may be continuously adjusted by rotation of the shaft 118.

The shaft 118 is rotated in response to the fuel trim controller 36 which produces a control signal 119 (FIG. 1). Positioner 121 receives the control signal 119 and mechanically drives a lever 123 secured to the shaft 118. The response characteristics of the sensor 30, the controller 36 and the positioner 121 are chosen so that the motion imparted to the lever arm 123 will effect the desired change in fuel flow in light of the mechanical characteristics of DPCV 14, the actuator 42 and the set point adjustment mechanism 50.

In addition to the continuous adjustment of the set point in response to varying ambient conditions, the set point adjustment mechanism 50 is provided with a means for initially biasing the spring 100 to provide an initial (or neutral) set point based on the system characteristics and ambient conditions at start-up. The means comprises a pair of blocks 124, 125, attached at their upper ends to a plate 126. The blocks 124, 125 are each adapted to rotatably receive the shaft 118 and are laterally spaced apart to define a space which receives both the cam 116 and the cam follower 120. The shaft 118 extends through block 124 and projects outward through a slot 132 (partly illustrated in FIG. 3) in the side of the housing 102. The blocks 124, 125 are sized to conform to the interior of the housing 102 and are free to slide upward and downward therein. The cam assembly comprising the blocks 124, 125, the upper plate 126, the cam 116 and the shaft 118 are free to move as a unit within the boundary of the slot 132.

An adjusting bolt 134 extends through a hole 136 in the top plate 104 and engages the upper face of the plate 126. Rotation of the adjusting bolt 134 causes the cam assembly 116, 118, 124, 125, 126 to move downward which in turn causes the rod 108 to compress the spring 100 to change the set point of DPCV 14. Rotation of the adjusting bolt 134 in the opposite direction has the opposite effect. In FIG. 2, the cam assembly is illustrated in its uppermost position, which corresponds to a minimum differential pressure set point. In FIG. 3, the cam assembly is illustrated at an intermediate position. Once the desired neutral set point is set, the cam assembly may be secured by tightening bolts 135 extending through a plate 136 and into the block 124.

A bellows 138 is connected at one end to the retainer 110 and at the other end to the clevis 122 on the shaft 108. The bellows prevents dust and other contaminants from depositing on the shaft 108. Leakage around shaft 108 is prevented by a high pressure seal 139 located at the bottom of retainer 110.

In broad terms, the control system of the present invention controls excess air by varying the differential pressure across FCV 16 in response to the fuel trim controller 36 which compares the actual value of a control parameter in the stack gases with a desired value (i.e., set point) input to the fuel trim controller 36. Typically, the desired value will be based on load and input by a function generator (not shown) connected to shaft 22. By varying the differential pressure, the fuel flow to the burners is adjusted to either increase or decrease excess air, as necessary to maintain the set point. The differential pressure is changed by adjusting the set point on DPCV 14 by means of the set point adjustment mechanism 50.

The set point adjustment range of the adjustment mechanism 50 must be adequate to accomodate the expected range of air temperature changes and the like which affect performance, and yet must be limited so that a system failure will not result in the fuel supply being increased to an unsafe level. The cam 116 inherently limits the degree that the set point of DPCV 14 may be adjusted since full rotation of the cam cannot cause the rod 108 to travel more than a preselected distance. Moreover, in the particular embodiment illustrated, cam 116 is prevented from rotating fully by the housing 102 so that the set point can be trimmed no more than a predetermined amount, say ±20% from the neutral position. Thus, no matter what degree of rotation is imparted to the cam 116 from the positioner 121, a safe fuel-to-air ratio is maintained.

To start up the fuel supply system, the neutral set point of the set point adjustment mechanism 50 must be set to correspond to ambient conditions which determine the proper differential pressure across DPCV 14 at the time of start up. The neutral set point is input by loosening bolts 135 on the mounting plate 136 of the cam assembly and adjusting the bolt 134 to properly bias the spring 100. The cam 116 should be maintained at its midway position which corresponds to the lever arm 123 lying in the horizontal plane in the embodiment illustrated. Once the adjusting bolt 134 has been properly set, the locking nuts 135 can be tightened to prevent further movement.

Figure 4:
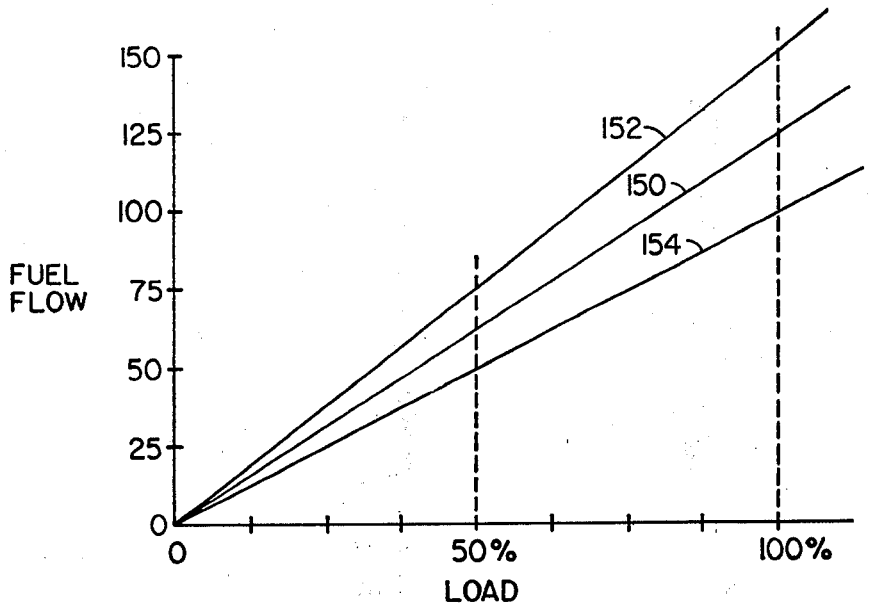
FIG. 4 is a diagram illustrating the load response characteristics of a fuel control system having the set point adjustment mechanism of the present invention.

Referring now to FIG. 4, the system characteristics for the present invention will be described. The graph of FIG. 4 illustrates the relationship between load and fuel flow at three values of the set point corresponding to three different ambient conditions. If line 150 represents the desired relationship at start-up, it can be seen that a fuel flow of 125 units is required to maintain 100% load at startup ambient conditions, while a fuel flow of about 62.5 units is required at 50% load. So long as the ambient conditions do not change, this relationship will hold true and the load control system of the burner will adjust the fuel flow corresponding to the changes in load only.

When ambient conditions change, however, a greater or lesser amount of fuel is required to operate with the proper air-to-fuel ratio at a given load. The upper operating line 152 represents the maximum increased fuel flow provided by the control system of the present invention. For all load conditions, a 20% increase in fuel flow provided. Operating line 154, conversely, represents the maximum decrease provided by the control system which is a 20% reduction in fuel flow at all operating load conditions.

The fuel trim control system of the present invention provides an equal percentage change in fuel flow over the entire operating range of the burner. If, for example, increased ambient temperature requires a 1% reduction in fuel flow, the 1% reduction is effected over the entire load range, as illustrated by the linear relationship for each operating line 150, 152, 154 in FIG. 4. This is desirable since it is unnecessary to readjust the "trim" of the fuel flow each time a load change causes FCV 16 to change the fuel flow rate.

Although the best mode contemplated for carrying out the present invention has been herein shown and described, it will be appreciated that variations and modifications may be made without departing from what is regarded to be the subject matter of the present invention.

What is claimed is:

1. In a system for controlling the flow of a fuel and air mixture to a burner wherein both the fuel and air flow rates are adjusted in a substantially fixed ratio in response to load changes on the burner, and wherein the fuel flow rate is adjusted by a fuel control valve mounted in a fuel supply line, an apparatus for marginally adjusting the fuel flow to the burner to maintain a combustion characteristic in the burner at a desired value, the apparatus comprising:

a self-adjusting valve mounted in the fuel supply line and upstream of the fuel control valve said self-adjusting valve including means for sensing the differential pressure across the fuel control valve and means for maintaining the pressure differential at a set point;

set means for changing the setting of the self-adjusting valve to thereby vary the set point and the differential pressure across the control valve;

means for monitoring the combustion characteristic; and means for operating the set means in response to a monitored change in the combustion characteristic to adjust the set point so that the combustion characteristic is returned to the desired value.

2. An apparatus as in claim 1, wherein the monitored combustion characteristic is the oxygen content of the exhaust gas from the burner and the set means includes means for increasing the set point when the oxygen content is higher than the desired value and for decreasing the set point when the oxygen content is lower than the desired value.

3. An apparatus as in claim 1, wherein the means for operating the set means includes:

a controller which generates a control signal in response to deviations between the desired and measured values of the combustion characteristics;

a positioner having an output link, said positioner having means for receiving the control signal and for positioning the output link in response to the control signal; and means operatively connected to both the output link and the set means for changing the setting of the adjusting valve in response to the position of the output link and thereby in response to the control signal.

4. An apparatus as in claim 1, wherein the sensing means comprises a diaphragm actuator including:

a housing;

a diaphragm mounted within the housing and defining a first chamber and a second chamber therein;

means for connecting the first chamber to the fuel line upstream of the fuel control valve and for connecting the second chamber downstream of the fuel control valve; and spring means attached at one end to the diaphragm and at the other end to the set means.

5. An apparatus as in claim 4 wherein the set means comprises:

a mechanical link mounted for reciprocating in the housing and attached at one end to the spring means;

a shaft mounted in the housing and capable of rotating about its axis, said axis being oriented generally transverse to the direction of travel of the mechanical link, and coupled to the output link so that pivotal movement thereof rotates the shaft; and a cam eccentrically mounted on the shaft and engaging the other end of the mechanical link to cause the mechanical link to rotate in response to rotation of the shaft.

6. Apparatus according to claim 5 including support means attached to the housing for movement in a direction generally parallel to the direction of movement of the mechanical link, means for releasably locking the support means to the housing in a plurality of relative positions; and means for mounting the shaft to the support means; whereby the shaft can be moved relative to the housing by correspondingly moving the support means.

* * * * *